US007040853B2

(12) United States Patent
Harsch et al.

(10) Patent No.: US 7,040,853 B2
(45) Date of Patent: May 9, 2006

(54) HORIZONTAL TRANSPORTING SYSTEM

(75) Inventors: Erich Harsch, Weingarten (DE); Rainer Reichenbach, Schlier (DE)

(73) Assignee: Mueller Weingarten AG, Weingarten (DE)

( * ) Notice: Subject to any disclaimer, the term of this patent is extended or adjusted under 35 U.S.C. 154(b) by 0 days.

(21) Appl. No.: 09/771,637

(22) Filed: Jan. 30, 2001

(65) Prior Publication Data

US 2001/0014279 A1 Aug. 16, 2001

(30) Foreign Application Priority Data

Feb. 10, 2000 (DE) ..... 100 05 827

(51) Int. Cl.
*B25J 5/02* (2006.01)

(52) U.S. Cl. ..... 414/749.1; 198/468.2; 414/751.1

(58) Field of Classification Search ..... 414/749.1, 414/751.1, 752.1, 753.1; 901/16, 21, 6; 198/801.1, 198/408.2; 74/490.08, 490.09
See application file for complete search history.

(56) References Cited

U.S. PATENT DOCUMENTS

| | | | | |
|---|---|---|---|---|
| 4,714,400 | A * | 12/1987 | Barnett et al. | 414/751.1 |
| 5,611,248 | A * | 3/1997 | Peltier | 901/21 X |
| 6,196,097 | B1 * | 3/2001 | Handel | 198/861.1 X |

FOREIGN PATENT DOCUMENTS

| | | | |
|---|---|---|---|
| DE | 43 09 661 | A1 | 12/1994 |
| DE | 100 10 079 | A1 | 9/2000 |
| DE | 199 11 795 | A1 | 9/2000 |
| EP | 0 210 745 | A2 | 2/1987 |
| EP | 0 672 480 | A1 | 9/1995 |
| EP | 0 693 334 | | 1/1996 |

* cited by examiner

*Primary Examiner*—Donald Underwood
(74) *Attorney, Agent, or Firm*—Hogan & Hartson L.L.P.

(57) ABSTRACT

A transfer system provided, in particular, for multi-stage presses for large components is distinguished by a favorable design with a low moving mass and allows large transporting steps. By the regulation of 2 stationary drives both in the direction of rotation in relation to one another and in the rotational speed, it is possible to realize all desired traveling curves in one plane. A straightforward construction makes possible a cost-effective, modular solution for a highly dynamic transfer system.

10 Claims, 6 Drawing Sheets

HORIZONTAL TRANSPORTING SYSTEM

BACKGROUND OF THE INVENTION

1. Field of the Invention

The invention relates to a transporting apparatus used in a press line or multi-stage press for transporting large components.

2. Discussion of the Related Art

In the press, press line or multi-stage press for large components, transfer apparatuses are provided for transporting workpieces into the processing stages. Earlier transporting systems provided cam-drive-controlled longitudinal and lifting movements, and possibly transverse movements of the transporting apparatuses, which were derived from the main drive of a press and were thus forcibly synchronized with the ram movement (EP 0 210 745, FIG. 4). In recent systems according to EP 0 672 480 B1 or EP 0 693 334 A1, the transporting operation between individual processing stations takes place individually by individual transporting apparatuses, which allow, in particular, a universal capacity for movement of the workpiece transportation between individual processing stages. By means of such a drive, which is fully independent of the central drive of the press, or transportion of the workpiece with any desired degrees of freedom, it is possible to optimize the transporting operation of the workpiece in particular in relatively large press installations, such as in EP 0 672 480 or EP 0 693 334.

DE 4 309 661 A1 has disclosed a transporting apparatus in which there are provided carrying rails which are mounted in height-adjustable slides in the longitudinal extent over the entire press length, above the component-transporting plane. These carrying rails serve for mounting purposes and as a track for transporting carriages which each have dedicated drive systems which are independent of one another. The respective transporting carriages may be displaced separately with a number of degrees of freedom. Mounts for crossmembers are integrated in the transporting carriages. The crossmembers are provided with retaining elements, such as suckers, tongs or magnets, for accommodating workpieces and transporting purposes. The crossmembers are usually each retained and moved by two lateral transporting carriages. The transporting system disclosed is thus one in which transporting carriages with a dedicated drive can be displaced independently of one another on common horizontally arranged carrying rails. The masses which are to be moved are relatively large since, rather than being stationary, the drives are displaced along as well.

DE 199 11 759, which was not published before the priority date, discloses a transfer system for component transportation comprising a number of transporting systems which are arranged vertically on the press uprights between the forming stages. Each of these transporting systems has a dedicated drive system.

It is proposed in the above document for two drives to be configured, by regulation of rotational speeds and direction of rotation in relation to one another, such that a pivoting or transporting arm in operative connection therewith can execute any desired traveling curves in one plane. The disadvantage with the proposed system and the exemplary embodiments is the restriction to vertical attachment.

SUMMARY OF THE INVENTION

Taking the prior art as departure point, the object of the invention is to propose a highly flexible low-mass transporting system for forming machines which allows optimum adaptation of the movement sequences required by the component geometry and ensures this functionality in the case of horizontal attachment.

This object is achieved, taking a transporting system according to the preamble of claim 1 as departure point, by the characterizing features of claim 1. Advantageous and expedient development of the transporting system are specified in the subclaims.

The invention is based on the idea of further developing the drive system described in DE 199 11 769 such that horizontal attachment is also made possible. This horizontal attachment is necessary, for example, when, on account of the geometry of the workpieces, the transporting step is of such a magnitude that a vertical transporting system renders an increase in the press height necessary. A stationary attachment of 2 drives ensures the considerable reduction in the masses involved in the transportation. These drives can be regulated independently of one another in terms of rotational speed and direction of rotation. In operative connection with movement-transmission means, the movements are combined and it is possible to execute any programmable traveling curve in one plane.

Pinions and racks may preferably be used as movement-transmission means.

In contrast to a vertical attachment, the workpiece-bearing crossmember is fastened not on a pivoting lever but on an arm, slide or lifting column which executes a linear movement. The system comprises transporting carriages which each have dedicated drive systems and guides. The number of transporting carriages depends on the number of forming stages of the press. In this case, it is also possible for the blank feeder which is necessary upstream of the first forming stage likewise to be designed with this drive system.

In order to realize the independent routes of the individual transporting carriages, the drive systems are offset in relation to one another transversely to the component-transporting direction.

Further possible movements can be achieved by using drives for achieving pivoting movements of the crossmembers and thus for changing the position of the workpieces. For a sufficient clearance during die changeover, the entire transporting system, or the individual parts thereof, may be of height-displaceable design. The same apparatus may also be used to bring the transfer system to an optimum height in relation to the respective die set.

A considerable advantage of the transporting system proposed is the straightforward adaptation to the necessary transporting or step lengths even with a wide variety of different presses for large components. The adaptation to the required transporting step can take place just by a change in length of guide rails and movement-transmission means. By virtue of the design outlay being reduced as well, this system is thus a cost-effective modular system. Each transporting unit can be operated in a temporally optimum fashion in dependence on the respective ram or interfering-edge position in order to achieve high cycle speeds with short transporting times. It is likewise advantageous that each system can travel with dedicated step lengths and speeds, i.e. the acceleration values can be selected in dependence on the rigidity of the respective workpiece.

The stationary attachment of the drive motors is also favorable; this reduction in the moving masses makes possible a very dynamic transporting system with low power consumption. It is also favorable that the power supply is arranged in a stationary manner, which, by dispensing with moving lines, increases the function reliability.

Further advantages of the drive system are described in the inventort's DE100 11 796, disclosed herein with reference to the present invention.

Additional details and advantages of the invention can be gathered from the following description of a basic illustration and exemplary embodiments:

DETAILED DESCRIPTION OF PREFERRED EMBODIMENT

Figure 1:
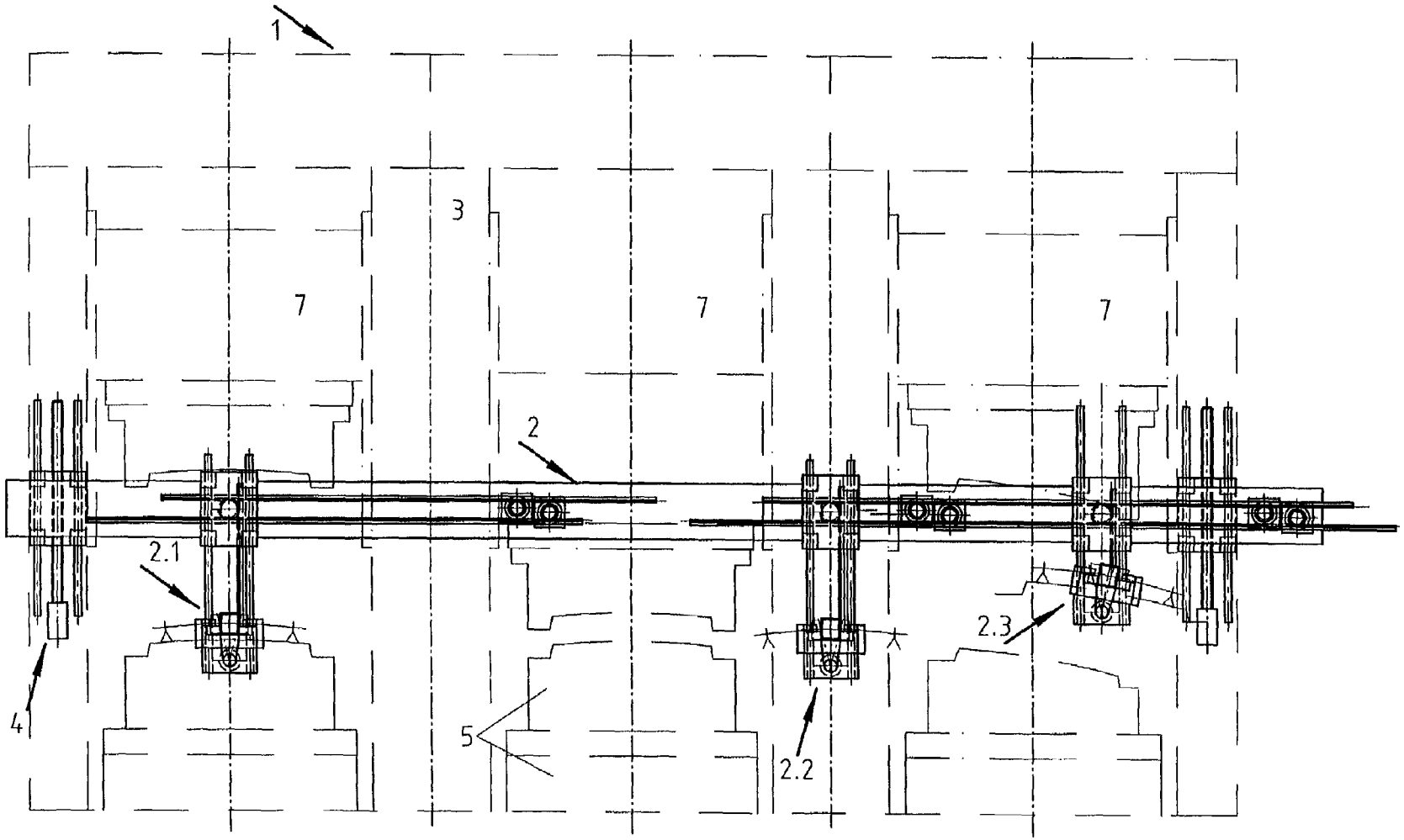
FIG. 1 shows a view of part of a multi-stage press for large components with a horizontal transfer system.

FIG. 1 illustrates processing or forming stages of a multi-stage press 1 for large components. The transfer system 2 according to the invention extends over the entire press length, as seen in the transporting direction. The drive and guides are installed in a horizontal arrangement with fastening points on press uprights 3. An adjusting apparatus 4 for the central or groupwise displacement of the transfer system 2 in the vertical direction is also located here. This function may be necessary for die changeover, for avoiding a collision between the die 5 and the transfer system 2. This is thus purely a set-up axis. A height adjustment of the transfer system 2 is possible as a further set-up function. Different transporting positions can be seen in the illustration. While, in the forming stage 6.1, workpiece removal by transfer system 2.1 is taking place, the transfer system 2.2 is in the parked position alongside the forming stage 6.2. The transfer system 2.3 is located in the forming stage 6.3 in the middle of a transporting function with the component mount pivoted. The different positions of the rams 7 can also clearly be seen, i.e., on account of the flexibility of the transfer systems 2.1–2.3, the press can be operated with phase-offset rams. The maximum loading to which the press is subjected by the deformation forces is thus considerably reduced, as is thus the torque on the drive shaft.

Figure 2:
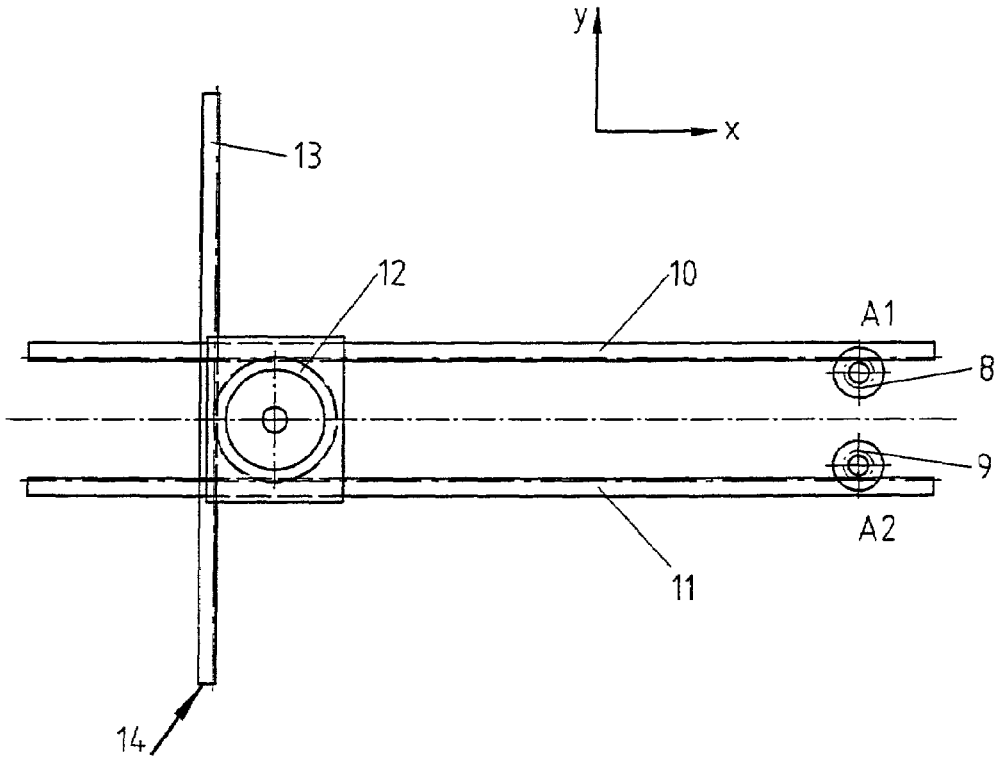
FIG. 2A shows a front view of a drive of the transfer system as a basic diagram with a table of movements.
FIG. 2B shows possible movements of the transfer system with identical ortaional speeds for gear wheels A1 and A2 and with one drive at standstill.
Figure 2:
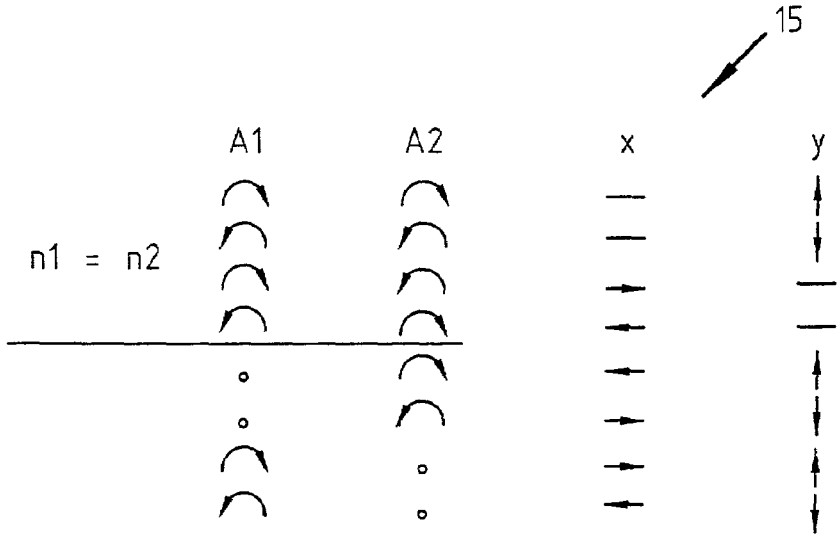

The schematic illustration in FIG. 2A shows the drive concept of a transporting system. Drives A1, A2 set gearwheels 8, 9 in rotation or keep them in the rest position. These gearwheels 8, 9 act on racks 10, 11 and thus affect the horizontal position thereof. At the same time, the racks 10, 11 are in operative connection with the gearwheel 12. Rack 13 is driven by gearwheel 12 and executes a vertical movement. The actual mount and retaining means 70 (shown in FIG. 4.) for the workpiece transportion are fastened at the point of articulation 14 of the rack 13, as will be described in more detail in the following figures. In the arrangement proposed, it is thus possible, by regulating the drives A1, A2, for the point of articulation 14 to reach any desired point in an X-Y co-ordinate system with its traveling curve.

FIG. 2B shows a table 15 of the possible movements with identical rotational speeds for A1 and A2 and with one drive at a standstill in each case. The illustration does not contain the large number of variants which may also additionally be achieved by different rotational speeds for A1 and A2.

The arrows illustrated in the table under A1/A2 show the direction of rotation of the drives in each case. X and Y are the axes of a planar co-ordinate system and the arrows indicate the movement direction in dependence on A1 and A2. By combining the movements, it is thus possible to advance up to any point of the planar co-ordinate system.

By way of example, the table 15 shows, with identical rotational speed and direction of rotation of the drives A1/A2, a purely vertical (Y-) movement of the point of articulation 14 and thus a lifting or lowering movement of the transporting system. A combination of movements takes place by way of different rotational speeds of A1/A2, to the extreme case where one drive does not execute any rotational movement, as can be seen from the last 4 schematic illustrations.

Gearwheels and racks are illustrated by way of example in FIG. 2A as movement-transmission means, but the task is also fulfilled by other drive components, such as separately driven toothed belts with toothed-belt pulleys.

Figure 3:
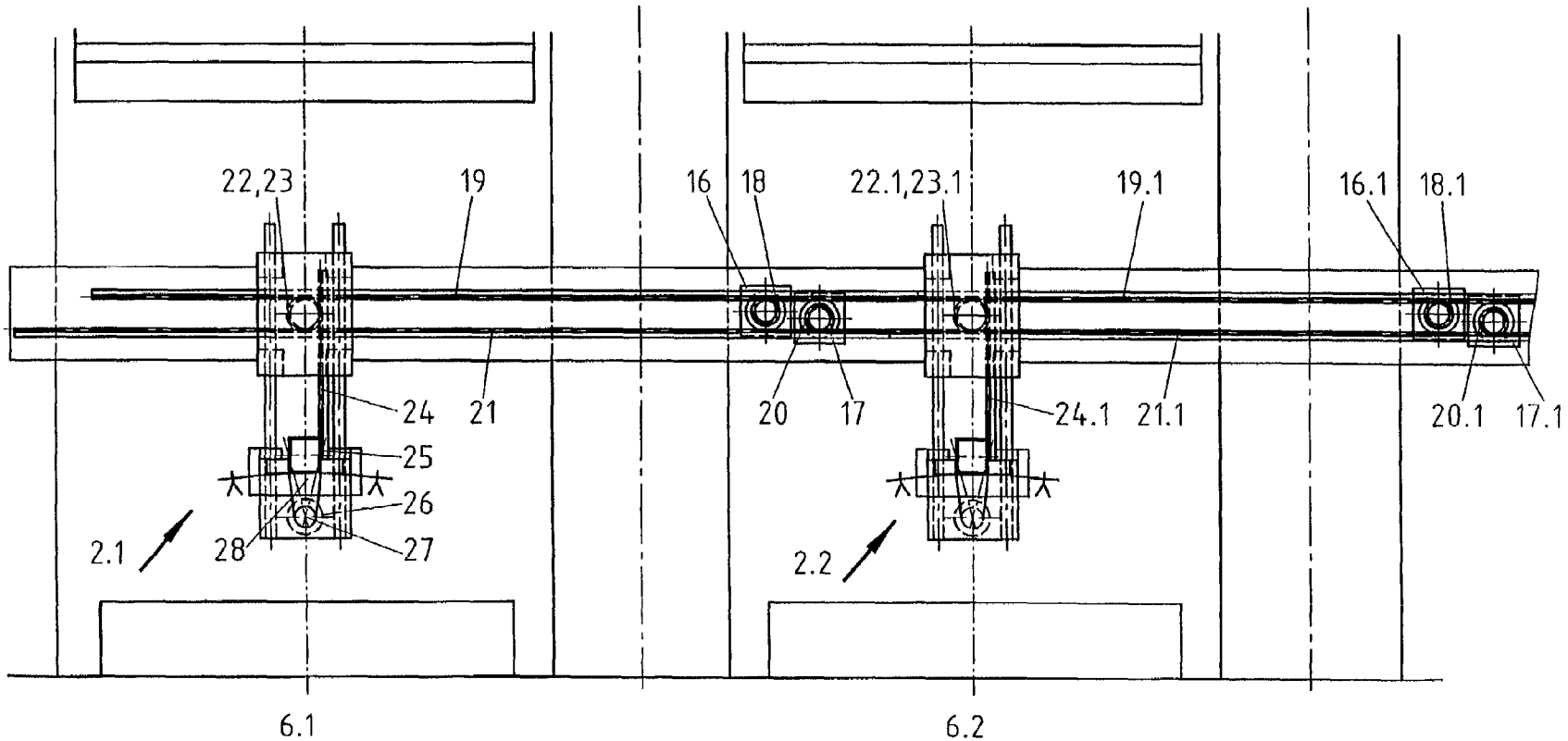
FIG. 3 shows a front view of the transfer system with 2 forming stages of the press.

Details of the transfer system are illustrated in FIG. 3. The stationary drives 16, 17 produce the movement of transfer system 2.1. Drive 16 is connected to gearwheel 18, which acts on the horizontally moveable rack 19. Drive 17 brings about, via a gearwheel 20, the horizontal movement of the rack 21. The racks 19, 21 are in operative connection with gearwheel 22, 23, which drives the rack 24. The construction and functioning of the rack 24 are comparable with a lifting column. The transfer system is of comparable construction to a cross-slide in terms of the movement plane, i.e. it is mounted such that it can be moved in 2 planes. By virtue of this construction, it is possible to realize the movement sequences which are described in more detail in FIG. 2. For accommodating the workpieces, use is made of the crossmember 25, which is fitted transversely to the transporting apparatus and is provided with component-retaining means. For accommodating and driving the crossmember 25 on both sides, it is also possible for the transfer system 2.1 to be attached mirror-invertedly on the opposite press side.

If a change in position is necessary for removing a workpiece or setting it down, crossbar or crossmember 25 may be of pivotable design. Crossmember 25 can be pivoted about the pivot axis 27 and by the angle 28 by means of a drive 26. Without an intermediate set-down location or orientating station is necessary, the transfer system proposed travels the entire route from, for example, forming stage 6.1 to forming stage 6.2 and the workpiece can be positioned correctly in the process.

The transfer system 2.2, the movement sequence of which is fully independent of transfer system 2.1, is of the same design. The same drive parts are designated with index 1. To aid clarity, an illustration of the dies and workpieces has been dispensed with. The central adjusting and lifting apparatus 4 is not illustrated either.

Figure 4:
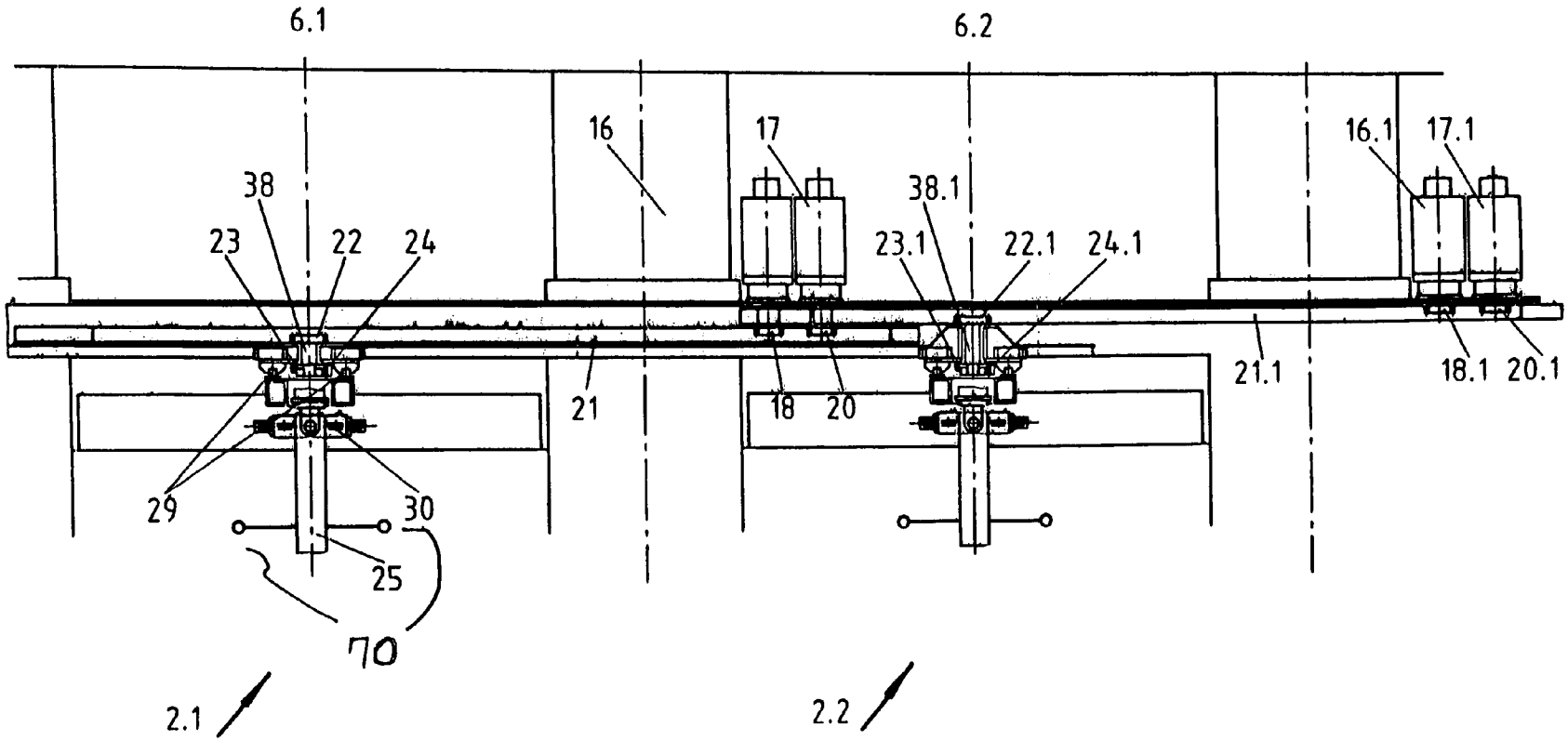
FIG. 4 shows a plan view of FIG. 3.

FIG. 4 shows a plan view of FIG. 3, in which rack 19 is not illustrated. As an essential design feature, it can be seen that the respective drive elements of the transfer systems 2.1 and 2.2 are offset spatially. This arrangement ensures a collision-free movement sequence. The gearwheel 20, which is connected to the drive 17, thus has a longer hub than the analogous gearwheel 20.1. The gearwheel 20 drives the rack 21, which thus drives gearwheel 22. The rotational movement of gearwheel 22 is transmitted to the rack 24, via the common shaft 38, by the gearwheel 23.

To understand the movement sequence, please refer again to FIG. 2. Also illustrated in FIG. 4 are the vertical linear guide 29 and the coupling system 30 for the crossmember 25.

Figure 5:
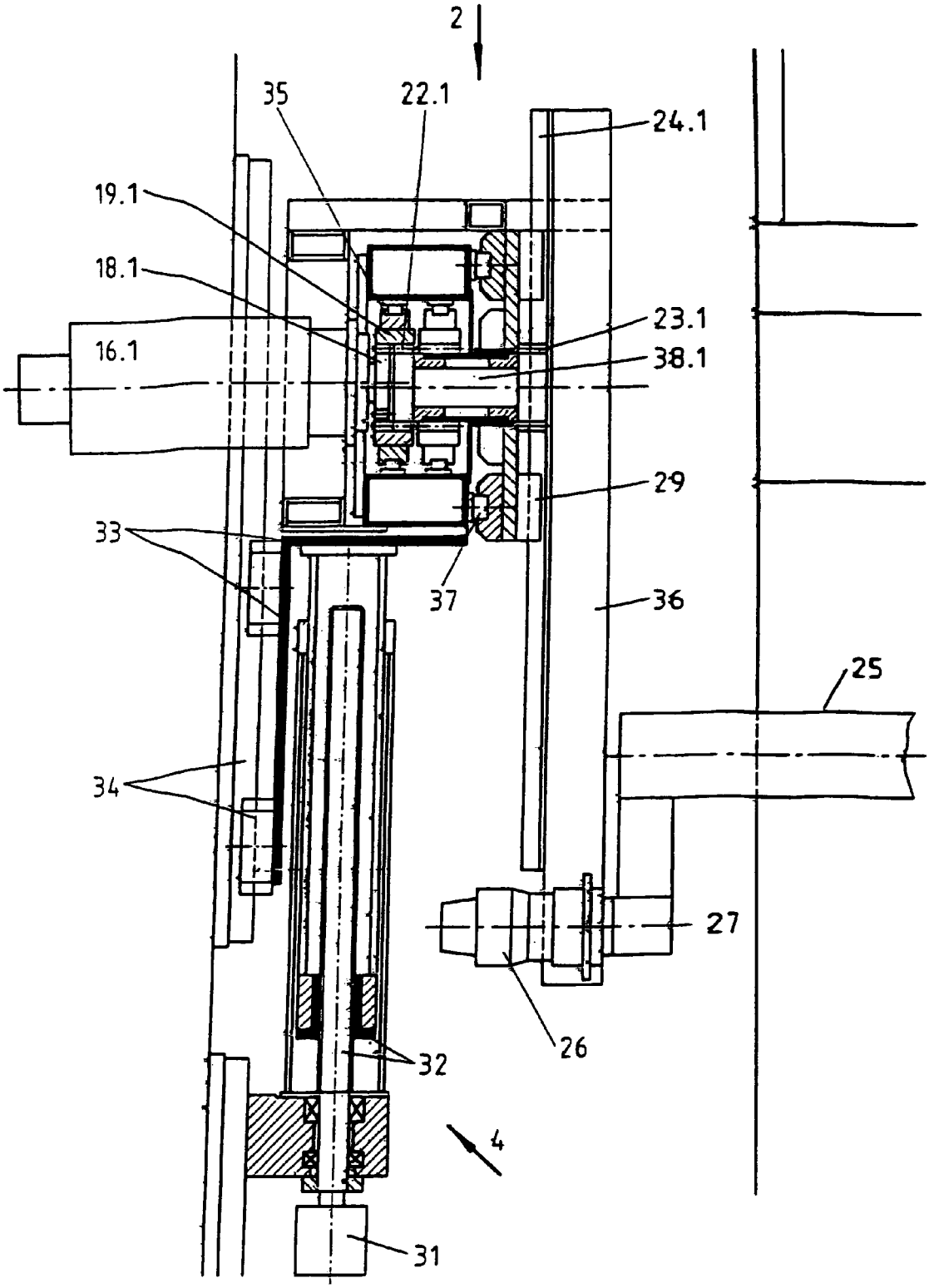
FIG. 5 shows a sectional illustration of a drive of the transfer system.

FIG. 5 shows the adjusting and lifting apparatus 4 and a detail of the transporting system 2 in a sectional illustration. The adjusting and lifting apparatus 4 has the function, on the one hand, of regulating the transporting system 2 to an optimum transporting height in relation to the die and, on the other hand, of moving the transporting system 2 vertically upward in order to avoid interfering edges during die changeover. This function can be carried out optionally for the entire transporting system 2 or just for individual transporting systems 2.1–2.n.

An embodiment with the possibility of individual adjustment is shown by way of example. Drive 31 drives, by way of example, a spindle-nut system 32 and this results in a change in position of the construction angle 33 in the vertical direction. The transporting system 2 is mounted on the angle 33 in a horizontal arrangement, and the linear guide 34 which is necessary for the overall height adjustment is fitted vertically. In an embodiment with central adjustment, a universal-joint shaft, which is connected to the central drive, would be provided instead of drive 31.

Of the transporting system 2.2, the following are illustrated: drive 16.1 with gearwheel 18.1,. which drives rack 19.1, which is guided in horizontal linear guides 35. The movement of the rack 19.1 drives gearwheel 22.1, which is connected to gearwheel 23.1 by a common shaft 38. The rack driven by the gearwheel 23.1 is designated 24.1. The movement-executing slide 36 is mounted in a moveable manner in the horizontal linear guides 37 and the vertical linear guides 29. Fastened at the bottom end of the slide 36 is drive 26, which can be pivoted about pivot axis 27 crossmenber 25, as is described in FIG. 3.

It can be seen, in particular, in FIG. 5 that despite the large number of degrees of freedom, a very good design solution for the exemplary embodiment has been found. Of particular note here is the compact and rigid design, which has additionally been achieved with low moving masses, as a result of which the power consumption of the drives is also reduced.

Figure 6:
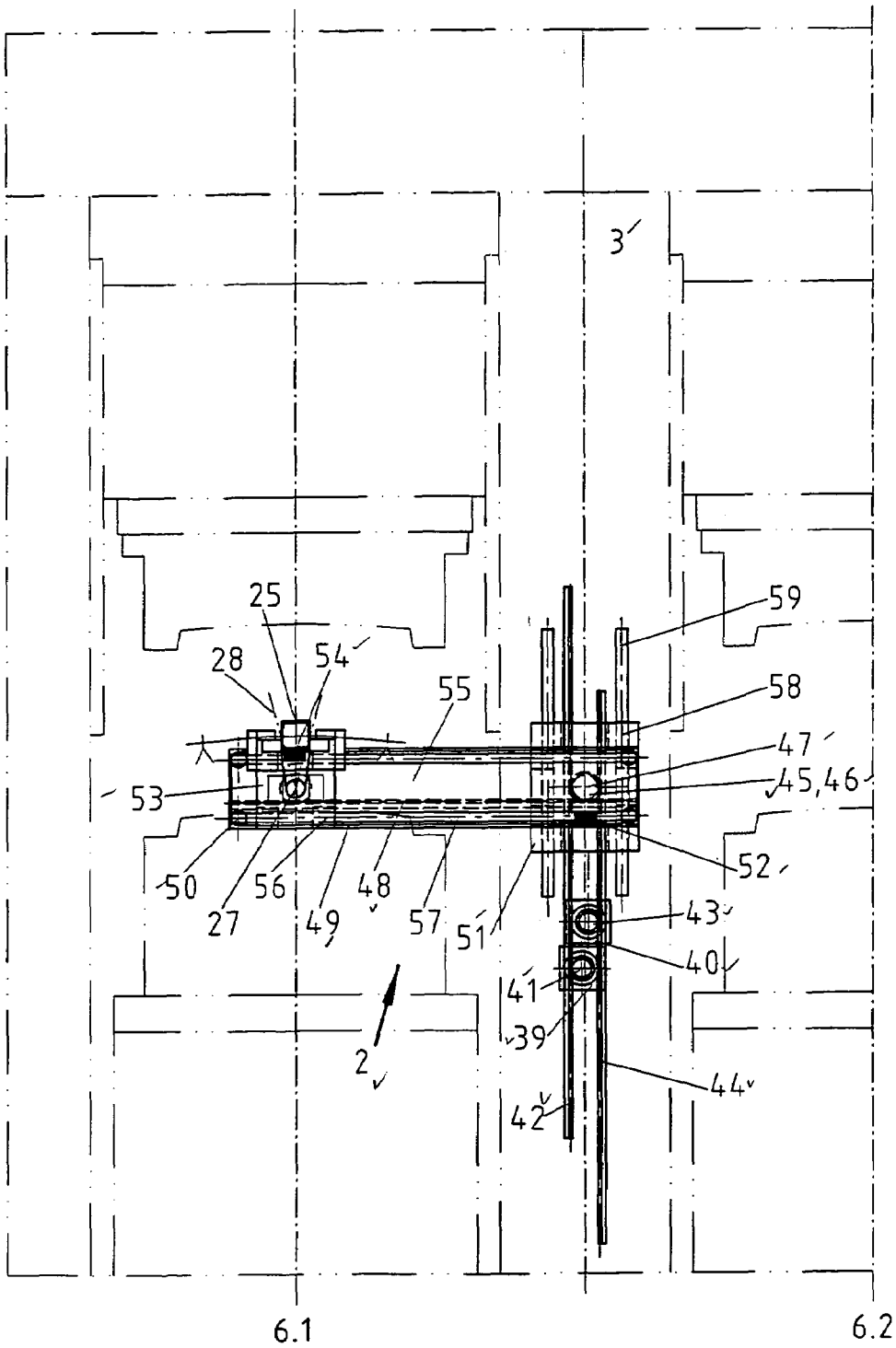
FIG. 6 shows a view of part of a multi-stage press for large components with a vertical transfer-system drive.

A further illustration, according to FIG. 6, shows an alternative embodiment of the transporting system 2.

The stationary drives 39, 40 are arranged on the press upright 3. Drive 39 drives rack 42 via gearwheel 41, and drive 40 drives rack 44 via gearwheel 43. Racks 42, 44 are in operative connection with gearwheel 45, which is connected to gearwheel 46 by a common shaft 47.

Gearwheel 46 drives rack 48, as a result of which the transporting system 2 is driven in a manner which has already been described in detail. A toothed belt 49 with deflecting rollers 50, as further drive means, is novel here. Said toothed belt 49 is firmly connected, on the one hand, to vertical slide 51 at the fastening point 52 and, on the other hand, to the horizontal slide 53 at fastening point 54. If, then, a horizontal movement of the basic carrier 55 is initiated via the drives 39, 40 and the following gear chain, then, on account of the fixed points 52, 54, the toothed belt 49 executes a type of rolling movement, as a result of which the horizontal slide 53 likewise executes via fixed point 54, the horizontal movement of the toothed belt 49. This combination of movements results in an approximately double speed of the horizontal slide 53 in relation to the basic carrier 55. Crossmember 25 with the component-retaining means is coupled to horizontal slide 53. The crossmember 25 thus travels from forming stage 6.1 to forming stage 6.2, in any desired curve in the plane, during component transportation. By way of example, component removal takes place in forming stage 6.1, while the component is set down in forming stage 6.2. During the forming operation, the horizontal slide 53, with crossmember 25, is located in the parked position in the region of the upright.

For reliable guidance and mounting, linear guides 56 are fastened on the horizontal slide 53 and guide rails 57 are fastened on the basic carrier 55.

In the same way, vertical slide 51 is also mounted in linear guide 58 and guide rails 59, which are fastened on the upright 3.

A possibility of pivoting by the pivoting angle 28 about the axis of rotation 27 may, as is described in FIG. 3, likewise be provided.

The invention is not restricted to the exemplary embodiment which has been described and illustrated. Thus, as an alternative to the gearwheel/rack drives, it is also possible to use spindle drives possibly with a step-down gear mechanism or toothed belts with toothed-belt pulleys.

LIST OF DESIGNATIONS

1 Multi-stage press for large components
2 Transporting system
3 Press upright
4 Adjusting and lifting apparatus
5 Die
6 Forming stage
7 Ram
8 Gearwheel
9 Gearwheel
10 Rack
11 Rack
12 Gearwheel
13 Rack
14 Point of articulation of workpiece-retaining means
15 Table of movements
16 Drive
17 Drive
18 Gearwheel
19 Rack
20 Gearwheel
21 Rack
22 Gearwheel
23 Gearwheel
24 Rack
25 Crossmember
26 Drive
27 Pivot axis
28 Pivoting angle
29 Linear guide (vertical)
30 Coupling
31 Drive
32 Spindle system
33 Construction angle
34 Linear guide (vertical)
35 Linear guide (horizontal)
36 Slide
37 Linear guide (horizontal)
38 Shaft
39 Drive
40 Drive
41 Gearwheel
42 Rack

43 Gearwheel
44 Rack
45 Gearwheel
46 Gearwheel
47 Shaft
48 Rack
49 Toothed belt
50 Deflecting rollers
51 Vertical slide
52 Fixed point
53 Horizontal slide
54 Fixed point
54 [sic] Basic carrier
56 Linear guide
57 Guide rails
58 Linear guide
59 Guide rail

The invention claimed is:

1. Apparatus for transporting workpieces in a press, press line, or multi-stage press, the apparatus comprising a number of processing stations, each processing station having an independent transporting apparatus for transporting the workpiece and executing a biaxial transporting movement, each independent transporting apparatus comprising:

a drive system including stationary drives and gear wheels, the drive system used for driving a crossmember;

a workpiece-retaining element connected with the crossmember;

first slides with linear guides on which the cross member is mounted; and a movement-transmission element connected with the crossmember, the movement-transmission element further including a rack drive for carrying out longitudinal, lifting and lowering movements of the first slides for the cross member, a drive for pivotably moving the crossmember, the drive being mounted on the first slides, and two parallel racks driven, via the gear wheels, by the stationary drives, for carrying out longitudinal movement, lifting and lowering movements of the first slides for the crossmember, wherein said stationary drives each act on the movement-transmission element, and the stationary drives move the gear wheels coordinately with the movement-transmission element so as to obtain a desired programmable traveling curve of the crossmember.

2. Apparatus according to claim 1, further comprising an adjusting and lifting apparatus for lifting and lowering each independent transporting apparatus.

3. Apparatus according to claim 2, wherein the adjusting and lifting apparatus includes a toothed-belt drive with a toothed-belt pulley.

4. Apparatus according to claim 1, wherein the movement-transmission element includes a toothed-belt drive with toothed-belt pulley.

5. Apparatus according to claim 1, wherein the movement-transmission element moves horizontally in the transporting direction.

6. Apparatus according to claim 1, wherein the two parallel racks are arranged horizontally.

7. Apparatus according to claim 1, wherein the two parallel racks are arranged vertically.

8. Apparatus according to claim 1, further comprising second slides, of which lifting and lowering movements are set up by the drive-gearwheels.

9. Apparatus according to claim 8, further comprising a shaft between the gearwheels, wherein the gearwheels are mounted on the second slides, and a first part of the gearwheels is fastened at one end of the shaft and a second part of the gearwheels is fastened at the other end of the shaft.

10. Apparatus according to claim 8, wherein the first slides include a vertical slide and the second slides include a horizontal slide, the movement-transmission element includes a toothed belt with deflecting rollers, and the toothed belt is connected to the vertical slide via a first fixed point and to the horizontal slide via a second fixed point.

* * * * *